US010518533B2

(12) United States Patent
Sakuma

(10) Patent No.: US 10,518,533 B2
(45) Date of Patent: Dec. 31, 2019

(54) HEAD MODULE AND LIQUID EJECTION APPARATUS

(71) Applicant: BROTHER KOGYO KABUSHIKI KAISHA, Nagoya-shi, Aichi-ken (JP)

(72) Inventor: Susumu Sakuma, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/856,451

(22) Filed: Dec. 28, 2017

(65) Prior Publication Data

US 2018/0178516 A1 Jun. 28, 2018

(30) Foreign Application Priority Data

Dec. 28, 2016 (JP) ..... 2016-255562

(51) Int. Cl.

| | |
|---|---|
| ***B41J 2/14*** | (2006.01) |
| ***B41J 2/045*** | (2006.01) |
| ***B41J 2/155*** | (2006.01) |
| *B41J 2/175* | (2006.01) |

(52) U.S. Cl.

CPC ..... *B41J 2/14233* (2013.01); *B41J 2/04515* (2013.01); *B41J 2/155* (2013.01); *B41J 2/175* (2013.01); *B41J 2002/14491* (2013.01); *B41J 2202/20* (2013.01)

(58) Field of Classification Search

CPC .... B41J 2/14233; B41J 2/04515; B41J 2/155; B41J 2/175

See application file for complete search history.

(56) References Cited

U.S. PATENT DOCUMENTS

| | | | | |
|---|---|---|---|---|
| 2006/0209138 | A1* | 9/2006 | Kachi | B41J 2/14233 347/68 |
| 2008/0174628 | A1 | 7/2008 | Kubo et al. | |
| 2013/0120501 | A1 | 5/2013 | Enomoto et al. | |
| 2014/0043388 | A1* | 2/2014 | Yoshimura | B41J 2/055 347/16 |
| 2015/0183217 | A1 | 7/2015 | Hagiwara | |
| 2016/0325544 | A1 | 11/2016 | Takahashi et al. | |
| 2016/0347063 | A1 | 12/2016 | Hayashi et al. | |

FOREIGN PATENT DOCUMENTS

| | | | |
|---|---|---|---|
| EP | 1 403 050 | A1 | 3/2004 |
| EP | 1 659 838 | A2 | 5/2006 |
| JP | 11-330328 | A | 11/1999 |

OTHER PUBLICATIONS

Extended European Search Report issued in related European Patent Application No. 17209700.8, dated Jun. 5, 2018.

* cited by examiner

*Primary Examiner* — Jason S Uhlenhake
(74) *Attorney, Agent, or Firm* — Merchant & Gould P.C.

(57) ABSTRACT

A head module includes a head, a driver IC, a heat spreader, a holder and a heat insulator. The head ejects liquid in response to the driver IC. The heat spreader is in thermal communication with the driver IC. The holder supports the head. The heat insulator is located to thermally isolate the heat spreader and the holder.

36 Claims, 9 Drawing Sheets

HEAD MODULE AND LIQUID EJECTION APPARATUS

CROSS-REFERENCE TO RELATED APPLICATION

This application claims priority from Japanese Patent Application No. 2016-255562 filed on Dec. 28, 2016, the content of which is incorporated herein by reference in its entirety.

FIELD OF DISCLOSURE

The disclosure relates to a head module and a liquid ejection apparatus including the head module.

BACKGROUND

There is a known semiconductor module including a chip-mounted board and a heat sink, as disclosed in, for example, FIGS. 1-4 of Japanese Laid-Open Patent Publication No. 11-330328. A surface of the chip-mounted board is in intimate contact with the heat sink via thermal grease. In the semiconductor module, the heat sink dissipates heat produced by the chip-mounted board. A resin-made or plastic enclosure case is directly bonded to the heat sink.

SUMMARY

In the semiconductor module, the enclosure case is directly bonded to the heat sink, so that the enclosure case may deform due to the heat from the heat sink. The deformed enclosure case may create a space or gap, between the heat sink and the enclosure case. For example, if such semiconductor module is employed in a head module configured to eject liquid, the liquid fragmented into mist during ejection may enter a space between the heat sink (e.g., a heat spreader) and the enclosure case (e.g., a holder), leading to a short-circuit failure in the chip-mounted board (e.g., a driver IC).

DETAILED DESCRIPTION

Figure 1:
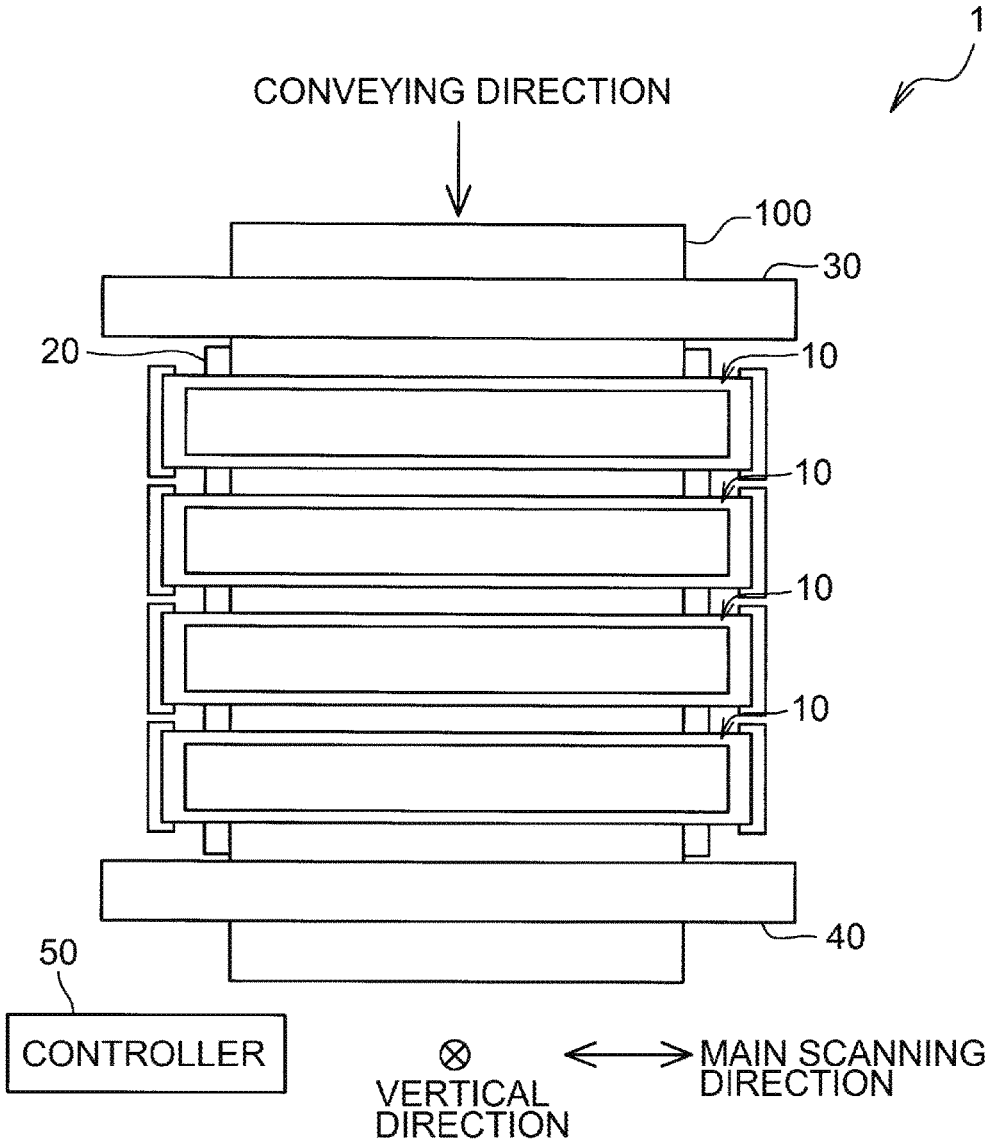
FIG. 1 is a plan view of a printer in an illustrative embodiment according to one or more aspects of the disclosure, illustrating relevant interior components of the printer.

As depicted in FIG. 1, a printer 1 includes four head units 10, a platen 20, roller pairs 30 and 40, and a controller 50.

The roller pairs 30 and 40, each include a pair of rollers. The controller 50 is configured to control the pair of rollers of each roller pair 30 and 40 to rotate in opposite directions while the pair of rollers holds a sheet 100 therebetween and to convey the sheet 100 in a conveying direction. The four head units 10 and the platen 20 are located between the roller pair 30 and the roller pair 40 in the conveying direction. The platen 20 is located below the four head units 10. The four head units 10 are spaced equi-distantly in the conveying direction. The controller 50 is configured to control each head unit 10 to eject one of different color inks. The head units 10 eject ink while the sheet 100 passes between the head units 10 and the platen 20. The ink landing on the sheet 100 forms an image on the sheet 100.

Each of the four head units 10 has the same or similar configuration. Accordingly, one head unit 10 is described in detail below. The head unit 10 is of a line type in which the head unit 10 fixed at a prescribed position ejects ink to the sheet 100. The head unit 10 is elongated in a main scanning direction which is perpendicular to the conveying direction and is parallel to a sheet support surface of the platen 20.

Figure 2:
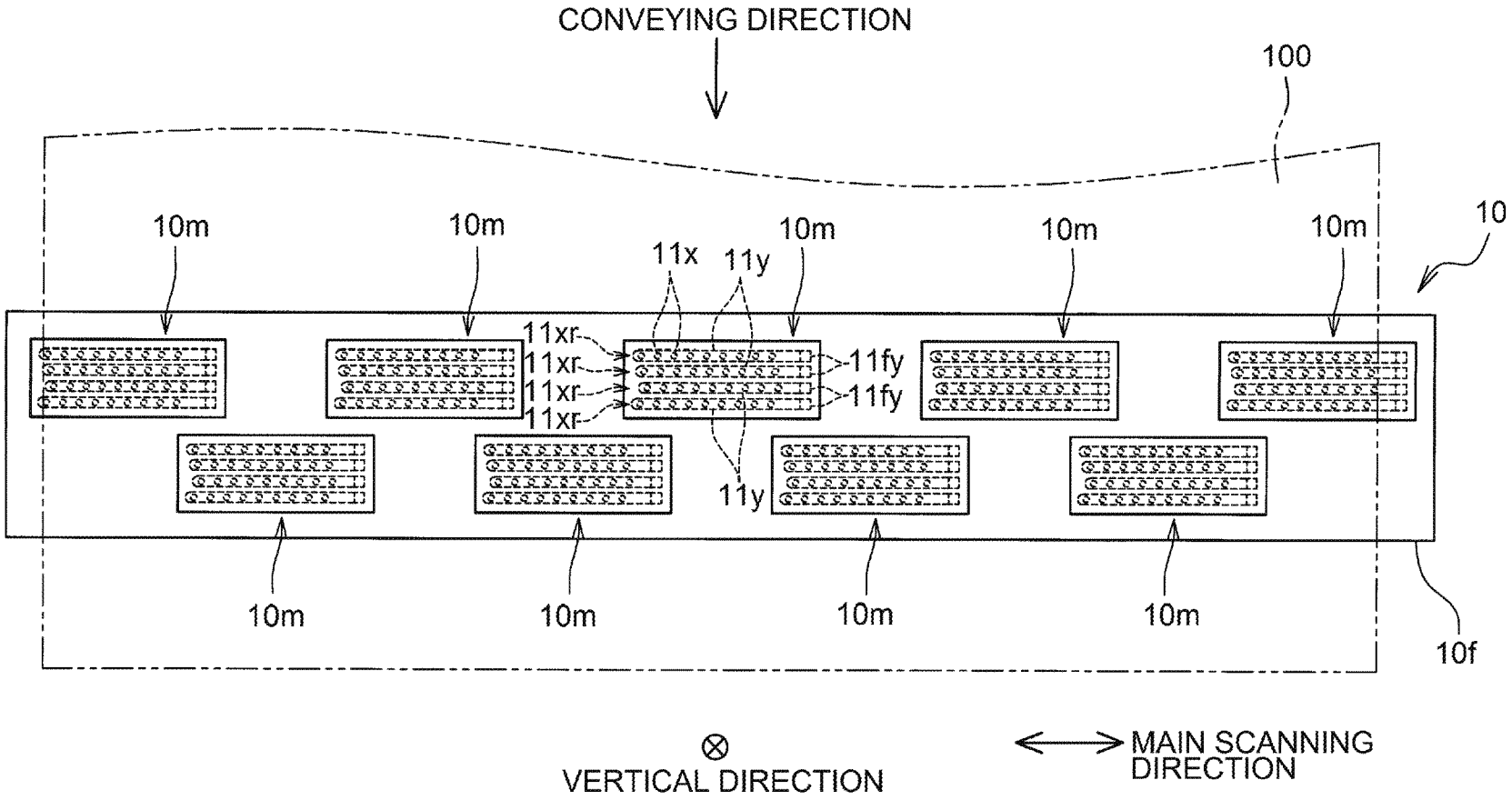
FIG. 2 is a plan view of a head unit of the printer.

As depicted in FIG. 2, the head unit 10 includes nine head modules 10*m* and a frame 10*f* that supports the nine head modules 10*m*. The nine head modules 10*m* are arranged in a staggered manner along the main scanning direction. Each of the nine head modules 10*m* has the same or similar configuration. Accordingly, one head module 10*m* is described in detail below. The head module 10*m* has a plurality of orifices 11*x* formed in a lower surface thereof.

Figure 3:
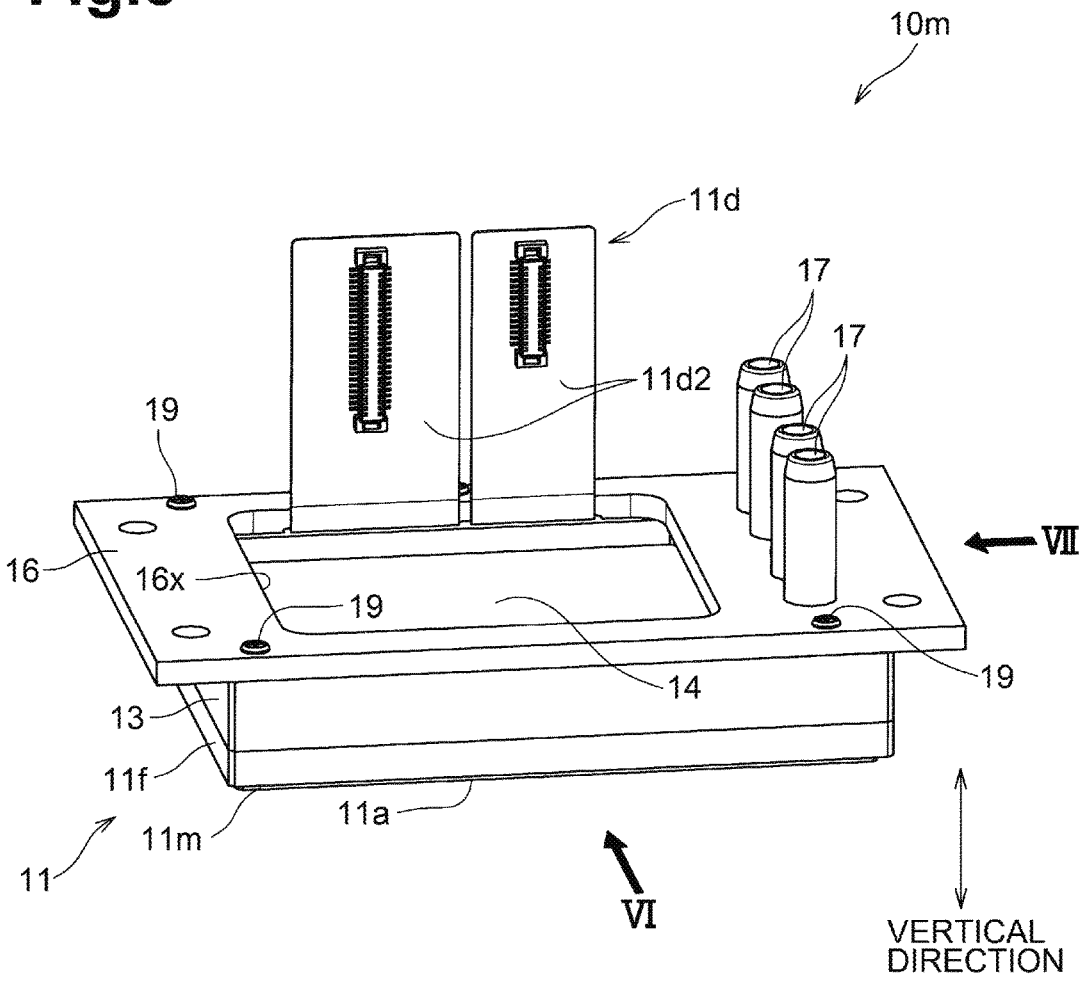
FIG. 3 is a perspective view of a head module of the printer.
Figure 4:
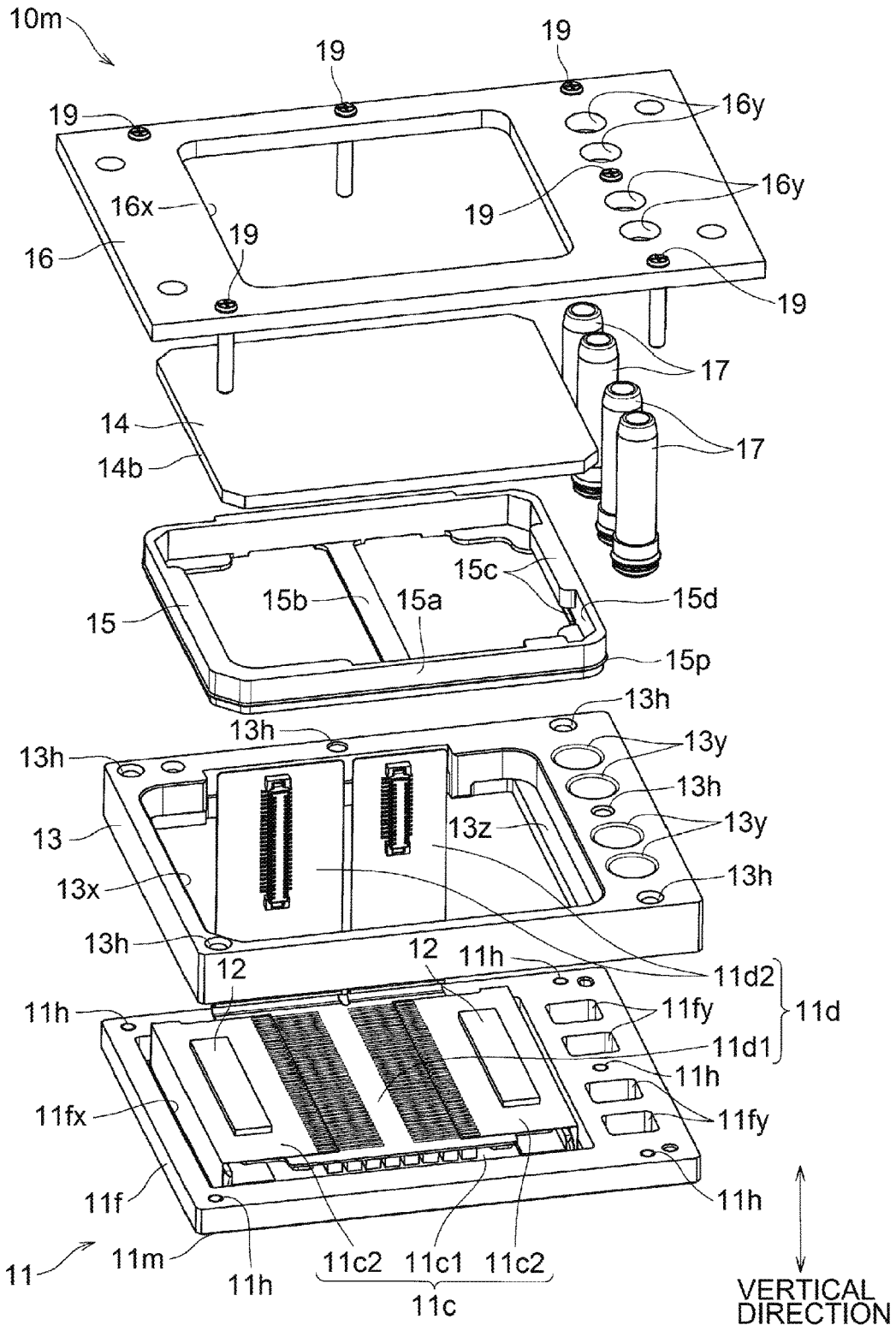
FIG. 4 is an exploded perspective view of the head module of the printer.

As depicted in FIGS. 3 and 4, the head module 10*m* includes a head 11, a pair of driver ICs 12, a holder 13, a heat spreader 14, a heat insulator 15, a support plate 16, and four pipes 17. The holder 13 supports the head 11. The holder 13 is made of, for example, epoxy resin. The heat spreader 14 is thermally connected to the driver ICs 12. The heat spreader 14 is made of metal, such as aluminum, having a relatively high thermal conductivity. The heat insulator 15 is disposed between the heat spreader 14 and the holder 13, and is in contact with the heat spreader 14 and the holder 13. The support plate 16 supports the holder 13. The support plate 16 is made of, for example, stainless steel (e.g., SUS430). The support plate 16 is supported by the frame 10*f* (refer to FIG. 2).

Figure 9:
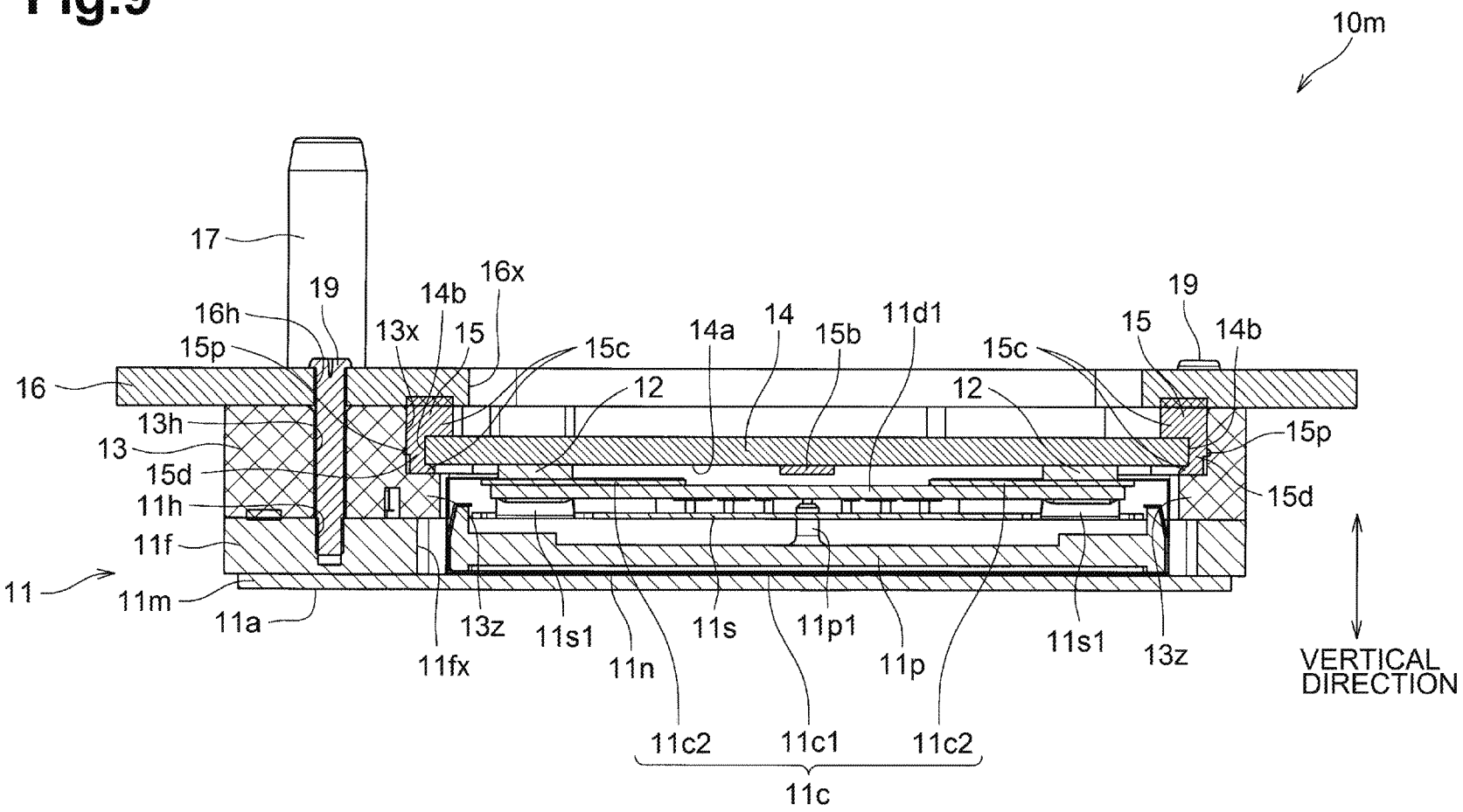
FIG. 9 is a cross-sectional view of the head module taken along the line IX-IX of FIG. 7.

As depicted in FIG. 4, the holder 13 has six screw holes 13*h*. The head 11 has also six screw holes 11*h* (one of which is hidden and not depicted in FIG. 4). The support plate 16 has also six screw holes 16*h* (one of which is depicted in FIG. 9). A screw 19 is inserted into a first screw hole 11*h* of the head 11, a first screw hole 13*h* of the holder 13, and a first screw hole 16*h* of the support plate 16. Similarly, another screw 19 is inserted into a second screw hole 11*h* of the head 11, a second screw hole 13*h* of the holder 13, and a second screw hole 16*h* of the support plate 16. In short, six screws 19 are each inserted into a respective one of the six screw holes 11*h* of the head 11, the six screw holes 13*h* of the holder 13, and the six screw holes 16*h* of the support plate 16. The head 11, the holder 13 and the support plate 16 are fixed relative to one another by screwing the six screws 19 into the head 11, the holder 13 and the support plate 16 in their thickness direction.

Figure 5:
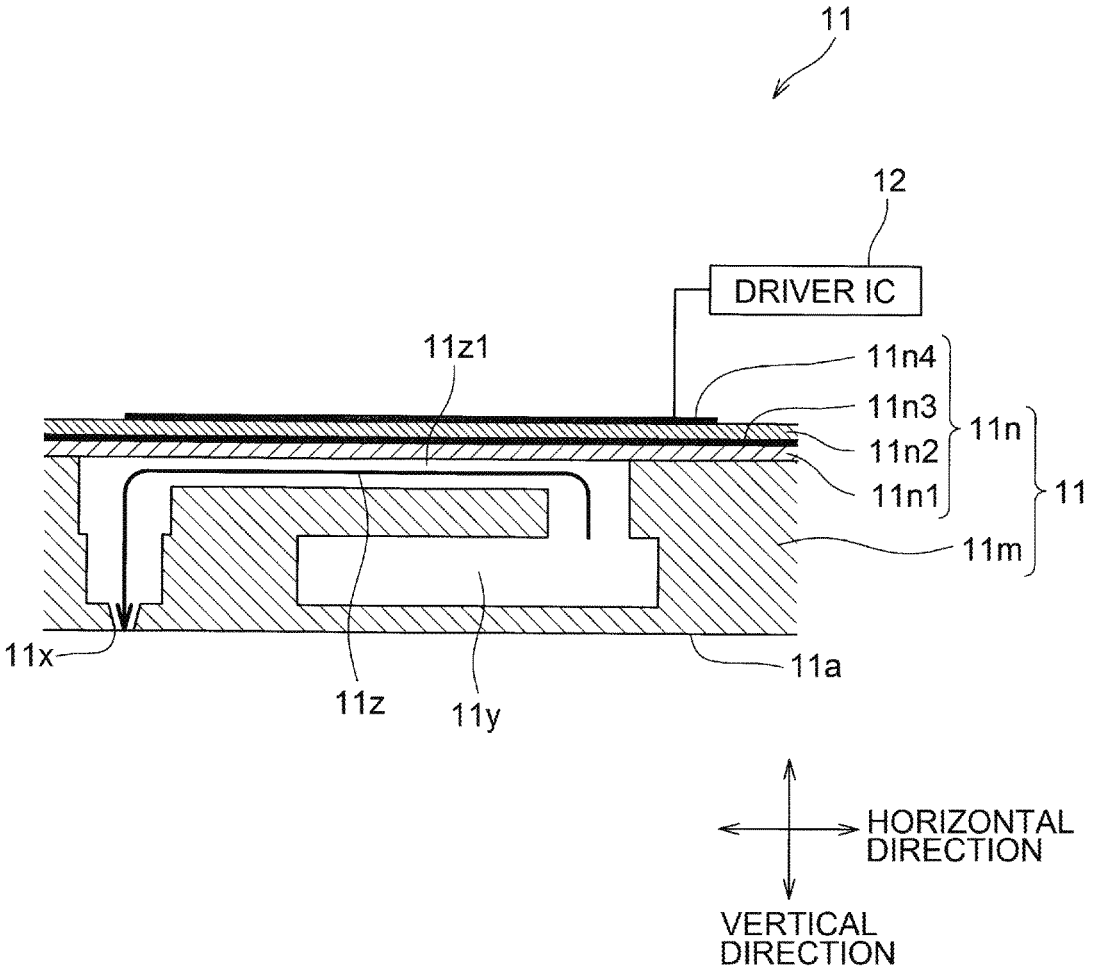
FIG. 5 is a partial cross-sectional view of a head module of the printer.
Figure 6:
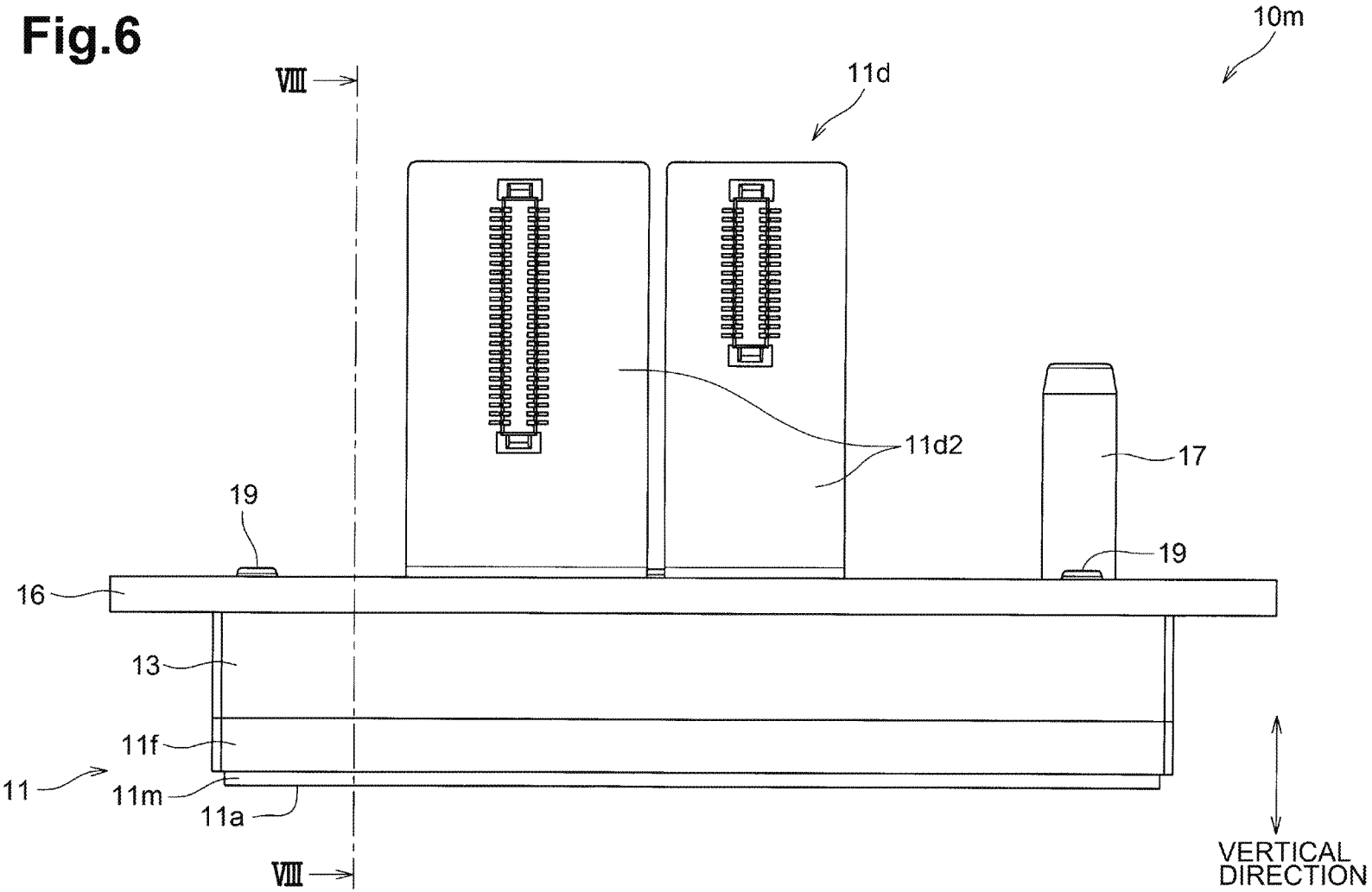
FIG. 6 is a side view of the head module viewed in the direction of the arrow VI of FIG. 3.
Figure 7:
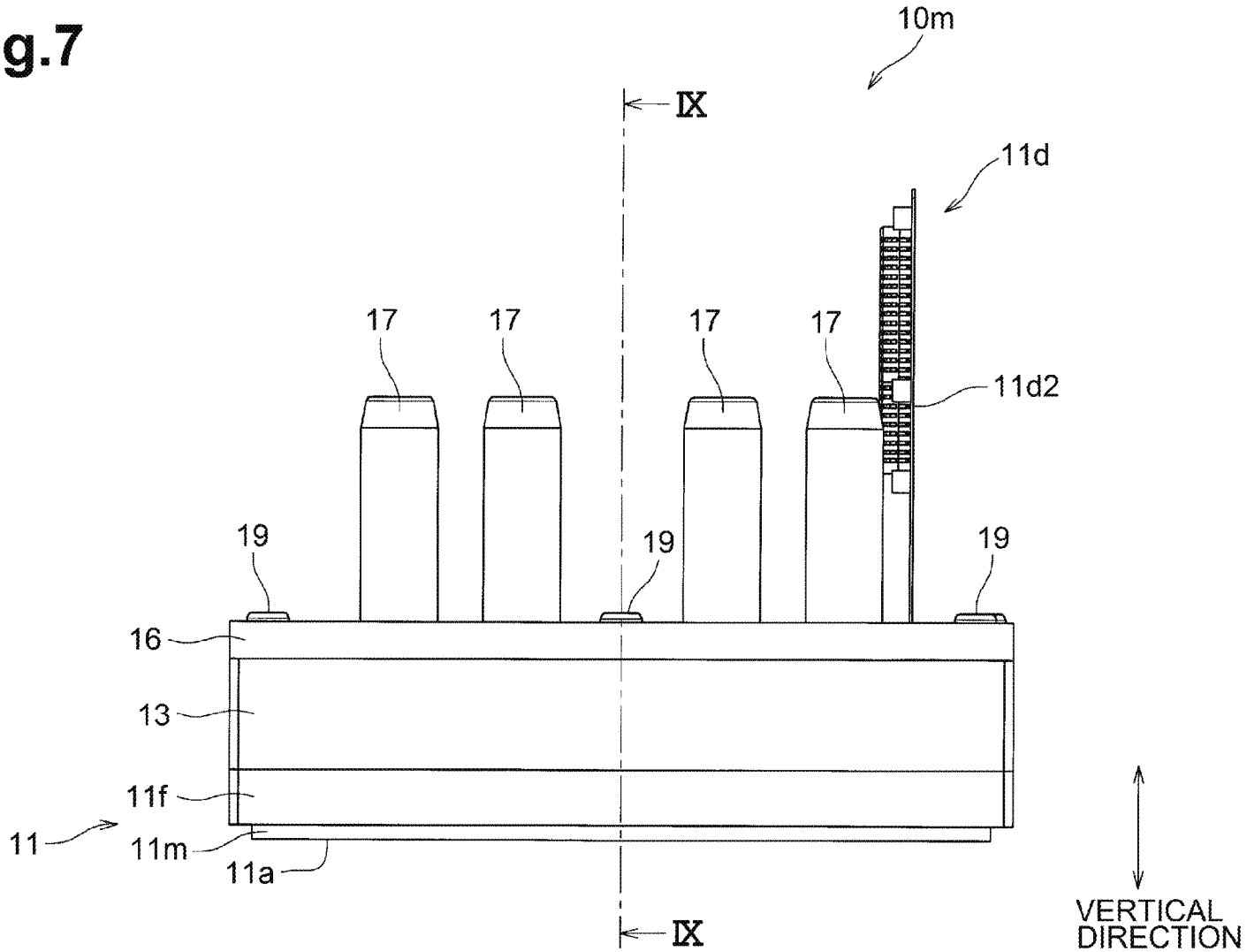
FIG. 7 is a side view of the head module viewed in the direction of the arrow VII of FIG. 3.

As depicted in FIGS. 3-5, the head 11 includes a flow channel substrate 11*m*, an actuator 11*n*, and a head frame 11*f*.

The flow channel substrate 11*m* has a lower surface (e.g., an ejection surface 11*a*) that is the lowest portion of the head module 10*m*. As depicted in FIGS. 2 and 5, the flow channel substrate 11*m* has a plurality of orifices 11*x* formed in the ejection surface 11*a*. As depicted in FIG. 2, the orifices 11*x* are arranged into four orifice rows 11*xr*. The four orifice rows 11*xr*, each extending in the main scanning direction, are arranged along the conveying direction. The flow channel substrate 11*m* has four common channels 11*y* and a plurality of individual channels 11*z* formed therein. The number of the individual channels 11*z* is the same as the number of the orifices 11*x*. Each of the individual channels 11*z* fluidly communicates with a respective one of the orifices 11*x*. Each of the four common channels fly is provided in correspondence with a respective one of the four orifice rows 11*xr*. The four common channels 11*y*, each extending in the main scanning direction, are arranged along the conveying direction. Each of the common channels 11*y* fluidly communicates with the individual channels 11*z* communicating with the orifices 11*x* of a corresponding one of the orifice rows 11*xr*. Each of the four common channels 11*y* fluidly communicates with a corresponding one of ink tanks (not depicted) via a respective one of the four pipes 17. The individual channel 11*z* extends from an outlet of the common channel fly to the orifice 11*x*, via a pressure chamber 11*z*1. Pressure chambers 11*z*1 are formed into an upper surface of the flow channel substrate 11*m*.

The actuator 11*n* is located at a generally central portion of the upper surface of the flow channel substrate 11*m*. The actuator 11*n* includes a diaphragm 11*n*1, a piezoelectric layer 11*n*2, a common electrode 11*n*3, and a plurality of individual electrodes 11*n*4. The diaphragm 11*n*1 is disposed on the upper surface of the flow channel substrate 11*m*, covering the plurality of pressure chambers 11*z*1. The piezoelectric layer 11*n*2 is disposed above the diaphragm 11*n*1. The common electrode 11*n*3 is disposed between the diaphragm 11*n*1 and the piezoelectric layer 11*n*2. The plurality of individual electrodes 11*n*4 is disposed on an upper surface of the piezoelectric layer 11*n*2. The common electrode 11*n*3 extends across the plurality of pressure chambers 11*z*1. Each of the individual electrodes 11*n*4 faces a respective one of the pressure chambers 11*z*1. The common electrode 11*n*3 is grounded. A voltage may be applied by the driver IC 12 to the individual electrode 11*n*4. The voltage may cause particular portions of the diaphragm 11*n*1 and the piezoelectric layer 11*n*2 between the individual electrode 11*n*4 and the pressure chamber 11*z*1 to deform toward the pressure chamber 11*z*1. This may reduce the volumetric capacity of the pressure chamber 11*z*1, thereby applying pressure to ink in the pressure chamber 11*z*1. The pressure may cause the ink to be ejected through the orifice 11*x*.

The driver ICs 12, electrically connected to the actuator 11*n*, drive the actuator 11*n*. The driven actuator 11*n* may apply energy to ink in the individual channels 11*z* to eject ink through the orifices 11*x*.

As depicted in FIG. 4, the head frame 11*f* is frame-shaped. The head frame 11*f* is fixed on the upper surface of the flow channel substrate 11*m* and outside a region where the plurality of orifices 11*x* are formed (the region occupied by the orifices 11*x* as depicted in FIG. 2). In other words, the plurality of orifices 11*x* is not formed under the frame-shaped portion of the head frame 11*f*. The head frame 11*f* has one opening 11*fx* and four through-holes 11*fy*. The opening 11*fx* and the through-holes 11*fy* extend through the head frame 11*f* in its thickness direction. As depicted in FIG. 2, each of the four through-holes 11*fy* fluidly communicates with a corresponding one of the four common channels 11*y*.

The actuator 11*n* and a chip on film ("COF") 11*c*, as depicted in FIG. 4, are disposed in the opening 11*fx*. The COF 11*c* has flexibility and includes a bonding portion 11*c*1 and a pair of folded portions 11*c*2. The bonding portion 11*c*1 is disposed at an upper surface of the actuator 11*n* and includes a plurality of terminals (not depicted). Each of the terminals of the bonding portion 11*c*1 is electrically connected to a corresponding one of terminals of the individual electrodes 11*n*4 formed on an upper surface of the actuator 11*n*. The folded portions 11*c*2 extend upward from ends of the bonding portion 11*c*1 and bend toward each other. Each folded portion 11*c*2 faces the upper surface of the actuator 11*n* with a space therebetween. Each of the folded portions 11*c*2 has a respective one of the driver ICs 12 disposed at an upper surface thereof.

As depicted in FIG. 4, opposing end portions of the folded portions 11*c*2 are each connected to a horizontal portion 11*d*1 of a flexible printed circuit ("FPC") 11*d*. The FPC 11*d* includes the horizontal portion 11*d*1 and a vertical portion 11*d*2. The horizontal portion 11*d*1 has a plurality of electrical terminals (not depicted). In correspondence with the electrical terminals of the horizontal portion 11*d*1, each of the folded portions 11*c*2 has a plurality of electrical terminals at an end portions thereof. Each electrical terminal of the horizontal portion 11*d*1 is electrically connected to a corresponding electrical terminal of the folded portions 11*c*2. The vertical portions 11*d*2 extends upward from one end of the horizontal portion 11*d*1. The vertical portion 11*d*2 is connected to the controller 50 (refer to FIG. 1). A control signal from the controller 50 is input to the driver ICs 12, via the FPC 11*d* and the COF 11*c*. Each of the driver ICs 12 is configured to generate a drive signal based on the control signal, and to output the drive signal to the actuator 11*n*.

Figure 8:
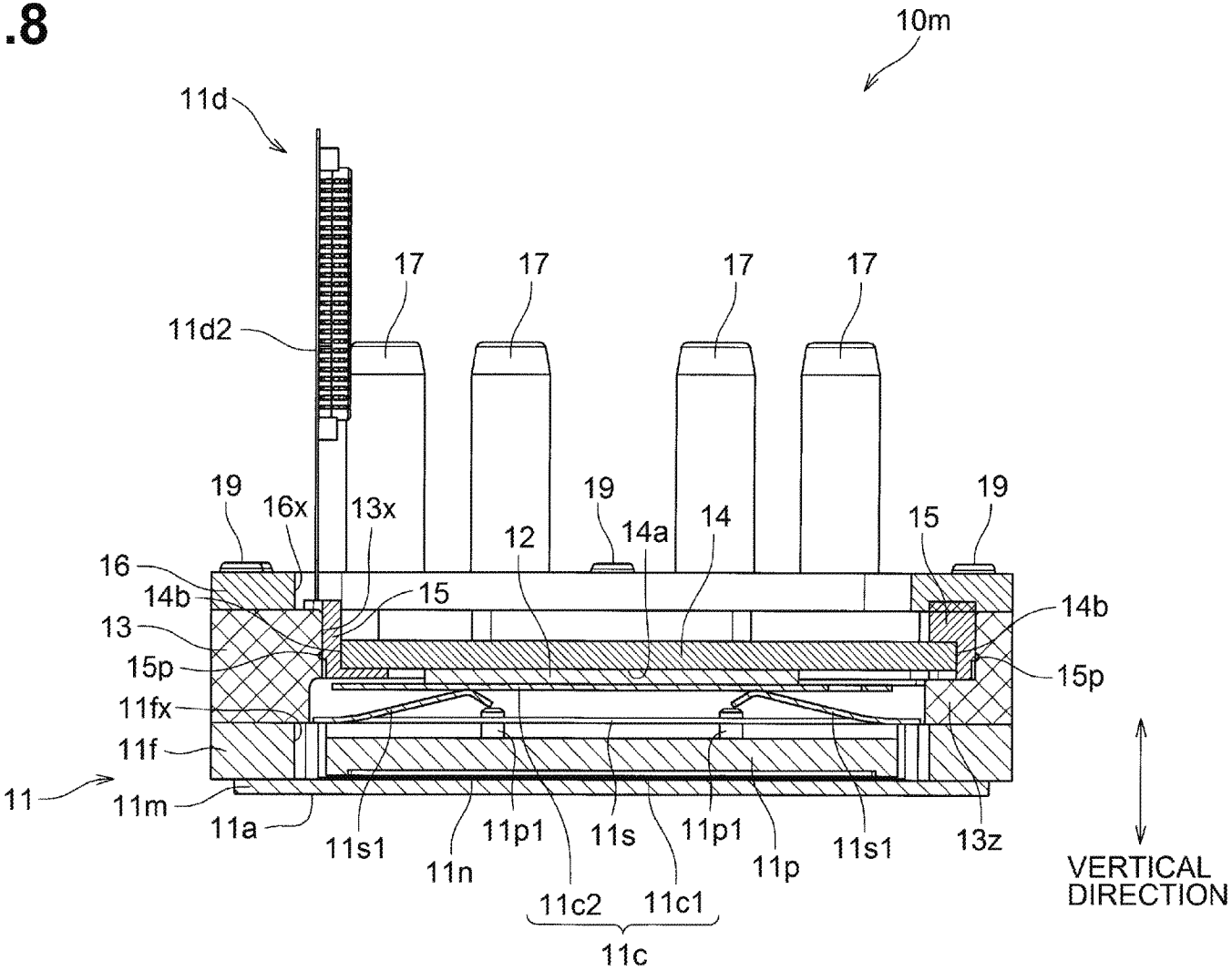
FIG. 8 is a cross-sectional view of the head module taken along the line VIII-VIII of FIG. 6.

As depicted in FIGS. 8 and 9, a pressing member 11*p* and a biasing member 11*s* are disposed in the opening 11*fx*. The pressing member 11*p* is disposed on an upper surface of the bonding portion 11*c*1 at a peripheral end of the bonding portion 11*c*1. The bonding portion 11*c*1 is located between the pressing member 11*p* and the actuator 11*n*. The pressing member 11*p* may prevent the bonding portion 11*c*1 from separating from the actuator 11*n*. The pressing member 11*p* has two projections 11*p*1 formed at an upper surface thereof. The projections 11*p*1 are in contact with the biasing member 11*s*. The biasing member 11*s* is supported by the pressing member 11*p* via the two projections 11*p*1. In other words, the pressing member 11*p* supports the biasing member 11*s* from below via the two projections 11*p*1. The biasing member 11*s* includes a pair of elastic portions 110. Each of the elastic portions 11*s*1 is in contact with a particular portion of a lower surface of a respective one of the folded portions 11*c*2. The particular portion corresponds to a position where the driver IC is located. The elastic portions 11*s*1 urge the driver ICs 12 upward (e.g., in a direction in which the driver ICs 12 approach the heat spreader 14).

As depicted in FIG. 4, the holder 13 is frame-shaped and fixed to an upper surface of the head frame 11*f*. A lower surface of the holder 13 is in contact with the upper surface of the head frame 11*f*. The holder 13 has one opening 13*x* and four through-holes 13*y*. The opening 13*x* and the four through-holes 13*y* extend through the holder 13 in its thickness direction. As depicted in FIG. 9, the folded portions 11*c*2 and the driver ICs 12 are disposed in the opening 13*x*. Further, as depicted in FIG. 9, the heat spreader 14 and the heat insulator 15 are disposed in the opening 13*x*. A first through-hole 13*y* fluidly communicates with a first through-hole 11*fy*. A second through-hole 13*y* fluidly communicates with a second through-hole 11*fy*. A third through-hole 13*y* fluidly communicates with a third through-hole 11*fy*. A fourth through-hole 13*y* fluidly communicates with a fourth through-hole 11*fy*. In short, each of the through-holes 13*y* fluidly communicates with a corresponding one of the through-holes 11*fy*.

The holder 13 further includes a protruding portion 13*z*. As depicted in FIGS. 8 and 9, the protruding portion 13*z* protrudes from a peripheral surface of the holder 13 defining the opening 13*x*, into the opening 13*x*. As depicted in FIGS. 8 and 9, the heat insulator 15 holding the heat spreader 14 is supported on the protruding portion 13*z*.

As depicted in FIG. 4, the support plate 16 is frame-shaped, and fixed at an upper surface of the holder 13. A lower surface of the support plate 16 contacts the upper surface of the holder 13. The support plate 16 has one opening 16*x* and four through-holes 16*y*. The opening 16*x* and the four through-holes 16*y* extend through the support plate 16 in its thickness direction. The heat spreader 14 is exposed to an exterior of the head module 10*m*, via the opening 16*x*. A first through-hole 16*y* fluidly communicates with the first through-holes 13*y*. A second through-hole 16*y* fluidly communicates with the second through-hole 13*y*. A third through-hole 16*y* fluidly communicates with the third through-hole 13*y*. A fourth through-hole 16*y* fluidly communicates with the fourth through-hole 13*y*. In short, each of the through-holes 16*y* fluidly communicates with a corresponding one of the through-holes 13*y*. Each of the through-holes 16*y* has a diameter smaller than a corresponding one of the through-holes 13*y*.

A lower end portion of a first pipe 17 engages in the first through-hole 13*y* and the first through-hole 16*y*. A lower end portion of a second pipe 17 engages in the second through-hole 13*y* and the second through-hole 16*y*. A lower end portion of a third pipe 17 engages in the third through-hole 13*y* and the third through-hole 16*y*. A lower end portion of a fourth pipe 17 engages in the fourth through-hole 13*y* and the fourth through-hole 16*y*. In short, the four pipes 17 are independent of one another. A lower end portion of each of the four pipes 17 engages in a corresponding one of the through-holes 13*y* of the holder 13 and a corresponding one of the through-holes 16*y* of the support plate 16. An upper end portion of each of the four pipes 17 protrudes upward relative to an upper surface of the support plate 16. The pipes 17 fluidly communicate with the ink tanks (not depicted) disposed in the printer 1, via tubes connected to the upper end portions of the pipes 17. Ink in the ink tanks is supplied, via the pipes 17, to the through-holes 11*fy* fluidly communicating with the pipes 17. The ink is then supplied to the common channels 11*y* communicating with the through-holes 11*fy*. To return ink in the four common channels 11*y* to the ink tanks, the ink may flow to the through-holes 11*fy* communicating with the common channels 11*y*. The ink may then be returned to the ink tanks, via the pipes 17 communicating with the through-holes 11*fy*.

As depicted in FIG. 4, the heat spreader 14 has a generally rectangular plate shape. The heat spreader 14 entirely overlaps the actuator 11*n* when viewed in the vertical direction. As depicted in FIGS. 8 and 9, a lower surface 14*a* of the heat spreader 14 is in contact with an upper surface of the driver ICs 12. The lower surface 14*a* serves as a thermal contact surface with the driver ICs 12.

The driver ICs 12 are located between the head 11 and the heat spreader 14. The driver ICs 12 are enclosed by the holder 13 in the horizontal direction and held between the head 11 and the heat spreader 14 in the vertical direction. In other words, the driver ICs 12 are covered by the holder 13, the head 11 and the heat spreader 14, as depicted in FIGS. 4, 8 and 9.

As depicted in FIG. 4, the heat insulator 15 includes a generally rectangular frame having two sets of opposed ends defining an open center portion. The frame extends around side peripheral surfaces 14*b* of the heat spreader 14. Each side peripheral surface 14*b* is perpendicular to the lower surface 14*a*. A bridge portion 15*b* extends across the open center portion between one set of the ends of the frame. A pair of tabs 15*c* are spaced apart from one another in a thickness direction of the heat insulator 15 (i.e. vertical direction) and extend from one end of the frame into the open center portion, with a connecting portion 15*d* extending vertically between the tabs 15*c*. An outer edge of the heat spreader 14 is received between the tabs 15*c* so as to be held therebetween. In other words, as depicted in FIG. 4, a recess is formed between the tabs 15*c* in an inner peripheral surface of one end of the frame 15*a*, and an outer edge of the heat spreader 14 is held between the tabs 15*c*.

A portion of the frame portion 15*a* defining a bottom of the recess corresponds to the connecting portion 15*d*. A portion of the frame portion 15*a* defining a pair of sides of the recess corresponds to the pair of tabs 15*c*. The pair of sides interposes the bottom of the recess therebetween in the vertical direction. In other words, one of the sides of the recess formed in the frame portion 15*a* is defined by one of the tabs 15*c*. The other one of the sides of the recess formed in the frame portion 15*a* is defined by the other one of the tabs 15*c*.

The outer edge of the heat spreader 14A engages in the recess defined by the pair of tabs 15*c* and the connecting portion 15*d*. More specifically, one of the tabs 15*c* contacts an end portion of an upper surface of the heat spreader 14. The other one of the tabs 15*c* contacts an end portion of a lower surface of the heat spreader 14. The connecting portion 15*d* defining the bottom of the recess of the frame portion 15*a* contacts the side peripheral surface 14*b* of the heat spreader 14. The side peripheral surface 14*b* connects an edge of the end portion of the upper surface of the heat spreader 14 and an edge of the end portion of the lower surface of the heat spreader 14*a* to each other. The connecting portion 15*d* is located between the side peripheral surface 14*b* and the holder 13.

The heat insulator 15 further includes a projection 15*p*. The projection 15*p* is disposed at and around an outer peripheral surface of the frame portion 15*a*. In other words, the projection 15*p* is provided at a particular portion of the connecting portion 15*d* or a particular side of the connecting portion 15*d*. The particular portion faces the holder 13, and the particular side is one of the two side surfaces of the connecting portion 15*d* opposite to the recess.

The heat insulator 15 is a single or one-piece member having the portions 15*a*-15*d*. In short, one heat insulator 15 is provided with the portions 15*a*-15*d*. The heat insulator 15 is made of elastic material, such as rubber (e.g., nitrile rubber ("NBR"), fluorine-based rubber, silicone-based rubber, ethylene-propylene-diene rubber ("EPDM"), and elastomer), and thus is able to self-restore to its original shape. The heat insulator 15 has higher elasticity than the heat spreader 14 and the holder 13. In shorter, the heat insulator 15 is more flexible than the heat spreader 14 and the holder 13.

A portion of the heat insulator 15 that overlaps or contacts other members or components in FIGS. 8 and 9 may be elastically deformed and compressed during the assembly of the head module 10*m*.

The head module 10*m* may be assembled as follows:

First, the heat insulator 15 holds the heat spreader 14. At this time, the outer edge of the heat spreader 14 engages in the recess defined by the pair of tabs 15*c* and the connecting portion 15*d*, and the lower surface 14*a* contacts an upper surface of the bridge portion 15*b*.

The heat insulator 15 holding the heat spreader 14 is positioned on the protruding portion 13*z* in the opening 13*x* of the holder 13. At this time, the projection 15*p* is pressed against the peripheral surface of the holder 13 defining the opening 13*x* and compressed.

Each of the pipes 17 is engaged in a respective one of the through-holes 13*y* of the holder 13. Subsequently, the head 11 is positioned at the lower surface of the holder 13, and the support plate 16 is positioned at the upper surface of the holder 13.

Subsequently, each of the screws 19 is screwed into the head 11, the holder 13 and the support plate 16. At this time, an upper portion of the heat insulator 15 is pressed against the lower surface of the support plate 16 and compressed. Assembly of the head module 10*m* thus completes.

The heat insulator 15 has a thermal conductivity lower than the heat spreader 14. More specifically, the thermal conductivity of the heat insulator 15 formed of, for example, silicone-based rubber, is approximately 0.16 [unit: W/(m·K)]. The thermal conductivity of the heat spreader 14 formed of, for example, aluminum, is approximately 236 [unit: W/(m·K)]. The thermal conductivity of the holder 13 formed of, for example, epoxy resin, is approximately 0.21 [unit: W/(m·K)].

As described above, the head module 10*m* includes the heat insulator 15 disposed between the heat spreader 14 and the holder 13 (refer to FIG. 9). The heat insulator 15 has a thermal conductivity lower than the heat spreader 14. This configuration may reduce thermal transfer between the heat spreader 14 and the holder 13, and may prevent deformation of the holder 13 due to the heat from the heat spreader 14.

The driver ICs 12 are covered by the holder 13, the head 11 and the heat spreader 14 (refer to FIGS. 4 and 9). This configuration may shield the driver ICs 12 with the holder 13, the head 11, and the heat spreader 14, and may prevent or reduce mist reaching the driver ICs 12.

The heat insulator 15 includes the pair of tabs 15*c*, configured to clamp the outer edge of the heat spreader 14 in its thickness direction (refer to FIGS. 4 and 9). This configuration may allow the heat spreader 14 to be held by the pair of tabs 15*c*.

The heat insulator 15 further includes the connecting portion 15*d* connecting the tabs 15*c* to each other and extending in the thickness direction of the heat spreader 14 (refer to FIGS. 4 and 9). This configuration may allow the heat spreader 14 to be held more securely by the pair of tabs 15*c* and the connecting portion 15*d*.

The heat insulator 15 is a single or one-piece member including the tabs 15*c* and the connecting portion 15*d* (refer to FIGS. 4 and 9). This configuration may allow the heat insulator 15 to be handled more readily than a heat insulator including the tabs 15*c* and the connecting portion 15*d* that are separate members. In addition, the heat spreader 14 may just be engaged in the recess defined by the pair of tabs 15*c* and the connecting portion 15*d* of the heat insulator 15 to assemble the heat spreader 14 and the heat insulator 15 together. In short, the head module 10*m* may be manufactured readily.

The heat insulator 15 includes the projection 15*p* disposed at a portion of the heat insulator 15 facing the holder 13. The projection 15*p* contacts the holder 13 and has elasticity (refer to FIGS. 4 and 9). Such a configuration that employs point contact between the holder 13 and the heat insulator 15 at the projection 15*p*, may ensure the sealability or effectiveness of seal between the holder 13 and the heat insulator 15 more reliably than a configuration that employs face contact between the holder 13 and the heat insulator 15.

The heat insulator 15 includes an intervening portion (e.g., the connecting portion 15*d*) located between the side peripheral surface 14*b* of the heat spreader 14 and the holder 13 (refer to FIG. 9). The projection 15*p* may be located at a portion of the intervening portion (e.g., the connecting portion 15*d*) facing the holder 13. In this configuration, the projection 15*p* may help to maintain the sealability or effectiveness of seal between the holder 13 and the heat insulator 15 when the heat spreader 14 is moved in a direction perpendicular to a thickness direction thereof, for example, due to the movement of the head module 10*m* during an image formation.

The heat insulator 15 is in contact with the heat spreader 14 and the holder 13 (refer to FIGS. 8 and 9). This configuration may prevent a gap or space from being created between the heat spreader 14 and the holder 13, leading to reduction in short-circuit failures in the driver ICs 12 due to the entry of mist.

The heat insulator 15 includes the frame portion 15*a* that surrounds the side peripheral surfaces 14*b* of the heat spreader 14 (refer to FIG. 4). In this configuration, the frame portion 15*a* enclosing the side peripheral surfaces 14*b* may reduce the holder 13 from being deformed by the heat from the heat spreader 14.

The heat insulator 15 has elasticity. In this configuration, elasticity of the heat insulator 15 may provide improved sealing between the heat spreader 14 and the holder 13. This may reliably reduce short-circuit failures in the driver ICs 12.

The heat insulator 15 includes the frame portion 15*a* that has elasticity and surrounds the side peripheral surfaces 14*b* of the heat spreader 14 (refer to FIG. 4). In this configuration, the frame portion 15*a* surrounding the side peripheral surfaces 14*b* of the heat spreader 14 may prevent the entry of mist, which may prevent short-circuit failures in the driver ICs 12 more reliably.

The heat insulator 15 further includes the bridge portion 15*b* connecting two opposing portions of the frame portion 15*a* (refer to FIG. 4). When the heat insulator 15 having elasticity supports the heat spreader 14, the heat insulator 15 may curl up, resulting in poor assembly. The configuration of the heat insulator 15 including the bridge portion 15*b* may reduce or prevent the heat insulator 15 from curling up, reducing poor assembly.

The heat insulator 15 is disposed between the heat spreader 14 and the support plate 16 (refer to FIGS. 8 and 9). This configuration may allow the heat insulator 15 to hold the heat spreader 14 securely in cooperation with the holder 13 and the support plate 16, as well as may prevent the support plate 16 from being deformed by the heat from the heat spreader 14.

While aspects are described in detail with reference to specific embodiments thereof, this is merely an example, and various changes, arrangements and modifications may be made therein without departing from the spirit and scope of the disclosure.

As long as the heat spreader is in thermal communication with the driver IC such that heat exchange occurs between the heat spreader and the driver IC, the heat spreader does not necessarily contact the driver IC directly but may contact the driver IC indirectly (e.g., via thermal grease).

A radiator (e.g., a member with a plurality of fins) may be disposed above a heat spreader. In this configuration, the radiator may be integral with the heat spreader and formed at an upper portion of the heat spreader. Alternatively, a radiator may be separate from a heat spreader and may be fixed to the heat spreader in contact with an upper surface of the heat spreader.

The heat spreader is not limited to being made of aluminum but may be made of another material having heat radiating effect (e.g., copper, alloy including copper, stainless steel, ceramic, and metal oxide including ceramic).

The heat spreader is not limited to being formed into a generally rectangular shape when viewed in the thickness direction of the heat spreader, but may be formed into another shape (e.g., a circular or elliptical shape).

The heat insulator is not limited to being made of rubber but may be made of material having elasticity (e.g., sponge) other than rubber.

As long as the projection has elasticity, the whole heat insulator does not necessarily have elasticity.

The heat insulator does not necessarily have elasticity.

The pair of tabs and the connecting portion of the heat insulator may be separate members.

The heat insulator does not necessarily include a pair of tabs. In other words, the heat insulator may only have a portion intervening between an end face of the heat spreader and the holder (e.g., the connecting portion or the intervening portion).

As long as the projection is disposed at a portion of the heat insulator facing the holder, the projection is not necessarily disposed at a side surface of the heat insulator. For example, the projection may be disposed at a lower surface of the heat insulator.

The projection may be omitted. In other words, contact between the holder and the heat insulator is not limited to point contact at the projection but may be face contact.

The heat insulator does not necessarily contact the heat spreader and the holder, but may face at least one of the heat spreader and the holder via a space.

The frame portion is not limited to being formed into a rectangular shape but may be formed into another shape (e.g., a circular or elliptical shape) corresponding to an outer edge of a heat spreader.

The holder, the heat insulator, and the supporting member are not limited to being formed in a frame shape, but may be formed in another shape.

The holder is not limited to being made of epoxy resin, but may be made of another material (e.g., metal or ceramic).

The supporting member is not limited to being made of stainless steel (e.g., SUS430), but may be made of another material (e.g., metal other than stainless steel, or ceramic). The supporting member may be omitted.

The number of the driver ICs is not limited to two, but may be one, or three or more. The driver IC may not necessarily be covered by the holder, the head and the heat spreader.

The actuator is not limited to a piezoelectric type that employs piezoelectric elements, but may be a thermal type that employs heating elements, or an electrostatic type that employs electrostatic force.

The head module of the disclosure is not limited to a line type, but may be a serial type.

The disclosure may be applied to various liquid ejection apparatuses including, but not limited to printers. The disclosure may also be applied to, for example, facsimile machines, copiers, and multi-functional devices.

Objects or media to which liquid is ejected are not limited to sheets but may be textiles, wood, and labels.

Liquid to be ejected from the orifices is not limited to ink, but may be another type of liquid (e.g., treatment liquid for agglutinating or precipitating ingredients in ink).

What is claimed is:

1. A head module, comprising:

a head including:

a flow channel substrate having an orifice and a flow channel in fluid communication with the orifice; and an actuator adjacent the flow channel;

a driver IC that is electrically connected to the actuator;

a heat spreader in thermal contact with the driver IC to facilitate heat exchange between the heat spreader and the driver IC, wherein the driver IC is located between the head and the heat spreader;

a holder that supports the head; and a heat insulator located between the heat spreader and the holder, the heat insulator having a thermal conductivity lower than the heat spreader.

2. The head module of claim 1, wherein the driver IC is surrounded by the holder, the head, and the heat spreader.

3. The head module of claim 1, wherein the heat insulator includes a pair of tabs including first and second tabs spaced apart in a thickness direction of the heat insulator and projecting from an inner surface of one end of the heat insulator, wherein an outer edge of the heat spreader is received between the first and the second tabs.

4. The head module of claim 3, wherein the heat insulator further includes a connecting portion that extends in the thickness direction and connects the first and second tabs to each other.

5. The head module of claim 4, wherein the heat insulator is a single member, wherein first and second tabs and the connecting portion are integrally formed portions of the single member.

6. The head module of claim 1, wherein the heat insulator includes a projection extending from an outer surface of the heat insulator towards the holder to contact the holder, and wherein the contact of the projection against the holder elastically deforms the projection.

7. The head module of claim 6, wherein the heat insulator includes an intervening portion located opposite an end face of the heat spreader in a horizontal direction perpendicular to the thickness direction of the heat insulator, the end face extending in the thickness direction of the heat spreader, the heat spreader having a thermal contact surface in thermal communication with the driver IC, the thermal contact surface extending perpendicularly to the end surface of the end face of the heat spreader; and wherein the projection is located at a portion of the intervening portion facing the holder.

8. The head module of claim 1, wherein the heat insulator is in contact with the heat spreader and the holder.

9. The head module of claim 8, wherein the heat insulator comprises an elastic material.

10. The head module of claim 9, wherein the heat insulator includes a frame portion that surrounds a side peripheral surface of the heat spreader.

11. The head module of claim 10, wherein the heat insulator further includes a bridge portion disposed in an area enclosed by the frame portion and connecting two opposing portions of the frame portion.

12. The head module of claim 1, wherein the heat insulator includes a frame portion that surrounds a side peripheral surface of the heat spreader.

13. The head module of claim 1, further including a support plate fastened to the head;

wherein the heat insulator is located between the heat spreader and the support plate such that an upper surface of the heat insulator contacts a lower surface of the support plate.

14. A liquid ejection apparatus, comprising:

the head module of claim 13; and a frame that supports the support plate.

15. A head module, comprising:

a driver IC;

a head configured to eject liquid in response to the driver IC;

a holder supporting the head;

a heat spreader in thermal communication with the driver IC, the heat spreader including a peripheral side surface;

a support plate opposite the head such that the holder is between the support plate and the head; and a heat insulator receiving the heat spreader so as to surround the peripheral side surface of the heat spreader to thermally isolate the holder and the support plate from the heat spreader.

16. The head module of claim 15, wherein the holder receives the heat insulator so as to surround a side surface of the heat insulator extending around an outer periphery of the heat spreader.

17. The head module of claim 15, wherein the heat insulator receives the heat spreader such than the heat spreader does not directly contact the holder.

18. The head module of claim 15, wherein the heat insulator receives the heat spreader such that the heat spreader does not directly contact the support plate.

19. The head module of claim 15, further comprising a plurality of fasteners connecting the support plate to the head such that the heat insulator and the holder are sandwiched between the support plate and the head.

20. The head module of claim 19, wherein the fasteners extend through openings in the holder.

21. The head module of claim 19, wherein the fasteners comprise screws, and wherein the head defines screw holes receiving the screws.

22. The head module of claim 15, wherein the heat insulator includes an inner surface defining an opening and surrounding at least a portion of the side of the heat spreader, wherein the heat spreader is within the opening of the heat insulator, and wherein the inner surface of the heat insulator receives at least the portion of the side surface of the heat spreader.

23. The head module of claim 15, wherein the heat insulator has a thermal conductivity lower than the heat spreader.

24. The head module of claim 15, wherein the holder defines an opening with a protruding portion extending into the opening, and wherein the heat insulator is supported on the protruding portion.

25. The head module of claim 15, wherein the heat insulator includes a projection extending from an outer peripheral surface of the heat insulator, and wherein the projection contacts an inner side surface of the holder.

26. The head module of claim 25, wherein the inner side surface of the holder elastically deforms the projection.

27. The head module of claim 15, further including a support plate fastened to the head;

wherein the heat insulator is located between the heat spreader and the support plate such that an upper surface of the heat insulator contacts a lower surface of the support plate.

28. A liquid ejection apparatus, comprising:

the head module of claim 27; and a frame that supports the support plate.

29. A method of assembling a head module, comprising;

providing a head including:

a flow channel substrate having an orifice and a flow channel communicating with the orifice; and an actuator adjacent the flow channel;

thermally attaching a heat spreader to a driver IC that is electrically connected to the actuator;

attaching the head to a holder; and thermally insulating the heat spreader from the holder, including situating the heat spreader in a heat insulator such that the heat insulator surrounds peripheral side surfaces of the heat spreader.

30. The method of claim 29, further comprising;

situating the heat insulator in a central opening of the holder.

31. The method of claim 30, wherein situating the heat spreader in the heat insulator includes situating the heat spreader in a central opening of the heat insulator.

32. The method of claim 31, wherein situating the heat spreader in the central opening of the heat insulator includes inserting an end of the heat spreader in a recess formed in an inside surface of the heat spreader.

33. The method of claim 29, wherein thermally insulating the heat spreader from the holder includes arranging the heat spreader such that the heat spreader does not directly contact the holder.

34. The method of claim 29, further comprising providing a support plate, wherein attaching the head to the holder includes situating the holder between the support plate and the head, and attaching the support plate to the head.

35. The method of claim 34, further comprising thermally insulating the heat spreader from the support plate.

36. The method of claim 35, wherein thermally insulating the heat spreader from the support plate includes arranging the heat spreader such that the heat spreader does not directly contact the support plate.

* * * * *